US008998775B1

(12) United States Patent
Chuang

(10) Patent No.: US 8,998,775 B1
(45) Date of Patent: Apr. 7, 2015

(54) OBLONG ORBITAL EXERCISING MACHINE

(71) Applicant: Yen-Chi Chuang, Taichung (TW)

(72) Inventor: Yen-Chi Chuang, Taichung (TW)

(73) Assignee: High Spot Health Technology Co., Ltd., Taichung (TW)

( * ) Notice: Subject to any disclaimer, the term of this patent is extended or adjusted under 35 U.S.C. 154(b) by 0 days.

(21) Appl. No.: 14/025,867

(22) Filed: Sep. 13, 2013

(51) Int. Cl.
*A63B 22/04* (2006.01)
*A63B 22/06* (2006.01)

(52) U.S. Cl.
CPC ..... *A63B 22/04* (2013.01)

(58) Field of Classification Search
CPC ..... A63B 22/001; A63B 22/0664; A63B 21/225; A63B 2022/0676; A63B 2022/067; A63B 2022/206
USPC ..... 482/51, 52, 57, 62
See application file for complete search history.

(56) References Cited

U.S. PATENT DOCUMENTS

| | | | | |
|---|---|---|---|---|
| 6,063,008 | A * | 5/2000 | McBride et al. | 482/52 |
| 6,183,398 | B1 * | 2/2001 | Rufino et al. | 482/57 |
| 7,854,691 | B2 * | 12/2010 | Long et al. | 482/57 |
| 7,946,962 | B2 * | 5/2011 | Long | 482/52 |
| 8,308,617 | B2 * | 11/2012 | Jhang et al. | 482/52 |
| 8,663,070 | B2 * | 3/2014 | Long | 482/52 |
| 2004/0147375 | A1 * | 7/2004 | Stevens | 482/57 |
| 2005/0026751 | A1 * | 2/2005 | Lo | 482/52 |
| 2008/0058168 | A1 * | 3/2008 | Lin | 482/52 |

* cited by examiner

*Primary Examiner* — Stephen Crow
(74) *Attorney, Agent, or Firm* — Alan D. Kamrath; Kamrath IP Lawfirm, P.A.

(57) ABSTRACT

An oblong orbital exercising machine includes a main frame, an upright, two swinging handles, a cycle movement mechanism, two tread bars, two sliding bars, two pedals, two cranks, two rollers, two guiding tracks, two pivot members, and two ball bearings. The top face of each of the guiding tracks has an arcuate convex shape to correspond to the respective roller. Each of the guiding tracks has two upward extending side wings formed on two opposite sides thereof. Each of the pivot members has a threaded rod threadedly connected with a respective one of the swinging handles. Each of the ball bearings is located between a respective one of the pivot members and a respective one of the swinging handles. Each of the ball bearings is mounted on the threaded rod of the respective pivot member.

2 Claims, 7 Drawing Sheets

OBLONG ORBITAL EXERCISING MACHINE

BACKGROUND OF THE INVENTION

1. Field of the Invention

The present invention relates to an exercising machine and, more particularly, to an exercising machine with an oblong orbit or cycle.

2. Description of the Related Art

A conventional in accordance with the prior art shown in FIGS. 1 and 2 comprises a main frame 40, an upright 41 mounted on a front portion of the main frame 40, two cranks 50 each having a first end pivotally connected with the upright 41, two sliding bars 45 each having a first end pivotally connected with a second end of a respective one of the cranks 50, two guiding tracks 49 each mounted on a rear portion of the main frame 40, two rollers 48 each mounted on a second end of a respective one of the sliding bars 45 and each slidable forward and backward on a respective one of the guiding tracks 49, two swinging handles 42 each pivotally connected with the upright 41, two tread bars 44 each having a first end pivotally connected with a lower end of a respective one of the swinging handles 42, and two pedals 46 each secured on a second end of a respective one of the tread bars 44. However, when each of the rollers 48 is moved on the respective guiding track 49, each of the rollers 48 is easily deflected rightward or leftward during movement, and is easily detached from the respective guiding track 49 due to a higher speed. In addition, after other parts of the exercising machine are assembled, each of the tread bars 44 is connected with the lower end of the respective swinging handle 42. However, it usually happens that each of the tread bars 44 cannot be precisely aligned with the lower end of the respective swinging handle 42 due to an angular deflection, so that each of the tread bars 44 and the lower end of the respective swinging handle 42 are not connected exactly and efficiently.

BRIEF SUMMARY OF THE INVENTION

In accordance with the present invention, there is provided an oblong orbital exercising machine comprising a main frame, an upright, two swinging handles, a cycle movement mechanism, two tread bars, two sliding bars, two pedals, two cranks, two rollers, two guiding tracks, two pivot members, and two ball bearings. The cycle movement mechanism is mounted on the main frame. The upright is mounted on a front portion of the main frame. Each of the cranks has a first end pivotally connected with the upright. Each of the sliding bars has a first end pivotally connected with a second end of a respective one of the cranks. Each of the guiding tracks is mounted on a rear portion of the main frame. Each of the guiding tracks has top face. Each of the rollers is mounted on a second end of a respective one of the sliding bars and is slidable forward and backward on the top face of a respective one of the guiding tracks. The top face of each of the guiding tracks has an arcuate convex shape to correspond to the respective roller. Each of the guiding tracks has two upward extending side wings formed on two opposite sides thereof. Each of the swinging handles is pivotally connected with the upright. Each of the pivot members is pivotally connected with a front end of a respective one of the tread bars and has a top portion provided with a threaded rod threadedly connected with a lower end of a respective one of the swinging handles. Each of the pedals is secured on a respective one of the tread bars. Each of the ball bearings is located between a respective one of the pivot members and the lower end of a respective one of the swinging handles. Each of the ball bearings is mounted on the threaded rod of the respective pivot member.

Preferably, each of the side wings of each of the guiding tracks is extended upward in an oblique manner from each of the two opposite sides of each of the guiding tracks.

According to the primary advantage of the present invention, when each of the rollers is moved on the respective guiding track, each of the rollers is guided by the top face of the respective guiding track, and is limited by the side wings of the respective guiding track, so that each of the rollers will not be deflected rightward or leftward during movement, and will not be easily detached from the respective guiding track to facilitate movement of the rollers.

According to another advantage of the present invention, when the threaded rod of each of the pivot members cannot be precisely aligned with the lower end of the respective swinging handle due to an angular deflection, each of the ball bearings on the threaded rod of the respective pivot member is located between the respective pivot member and the lower end of the respective swinging handle, so that the threaded rod of the respective pivot member and the lower end of the respective swinging handle are connected exactly and efficiently without incurring detachment.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
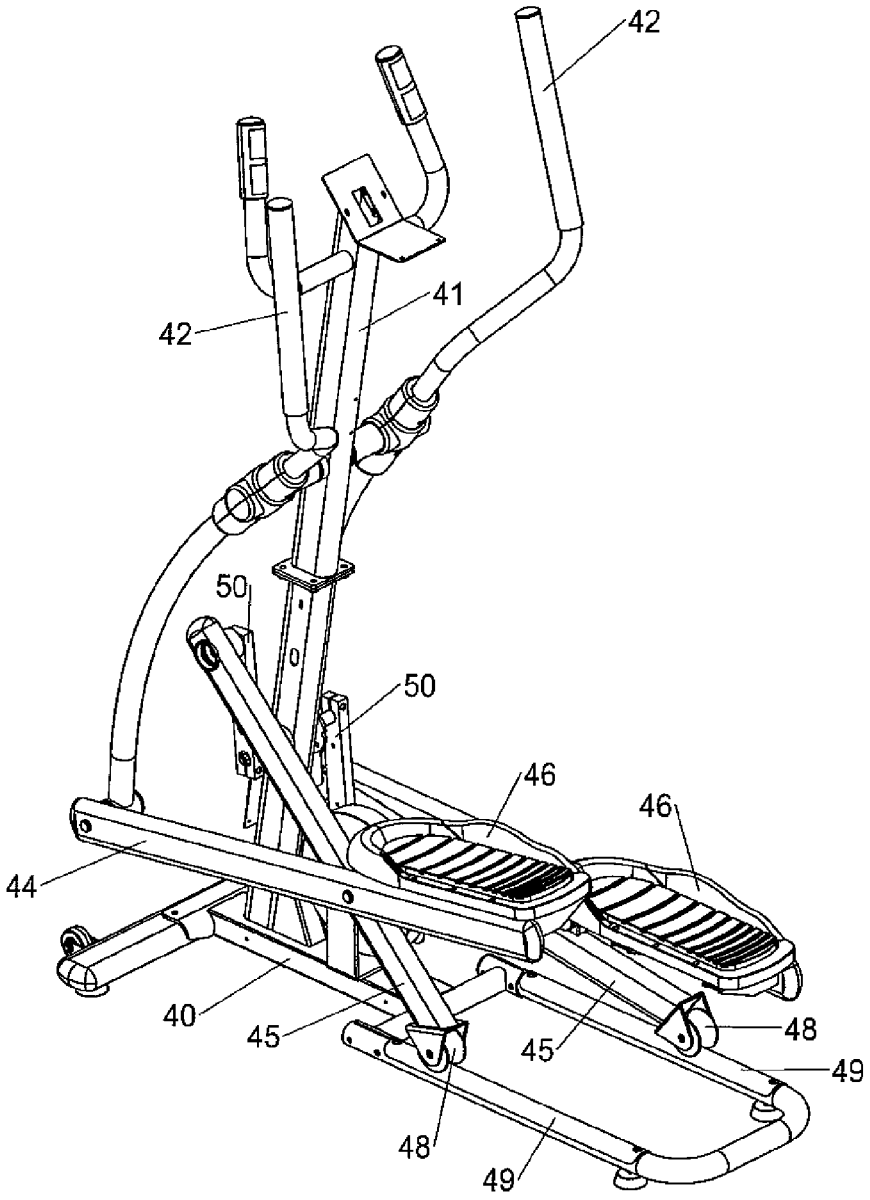
FIG.1 PRIOR ART
FIG. 1 is a perspective view of a conventional oblong orbital exercising machine in accordance with the prior art.
Figure 2:
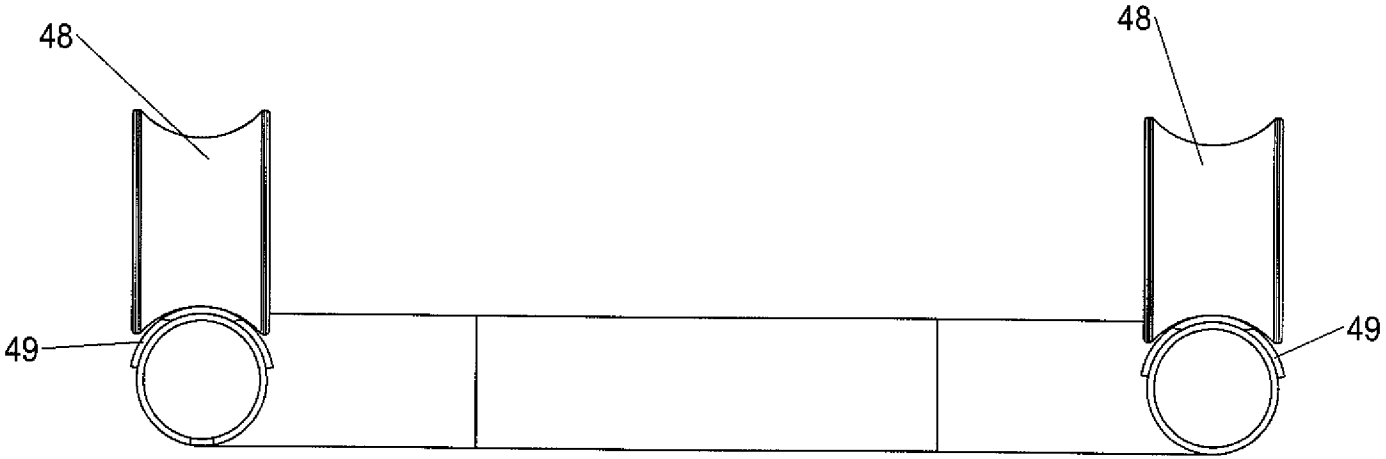
FIG.2 PRIOR ART
FIG. 2 is a locally enlarged cross-sectional view of the conventional oblong orbital exercising machine as shown in FIG. 1.
Figure 3:
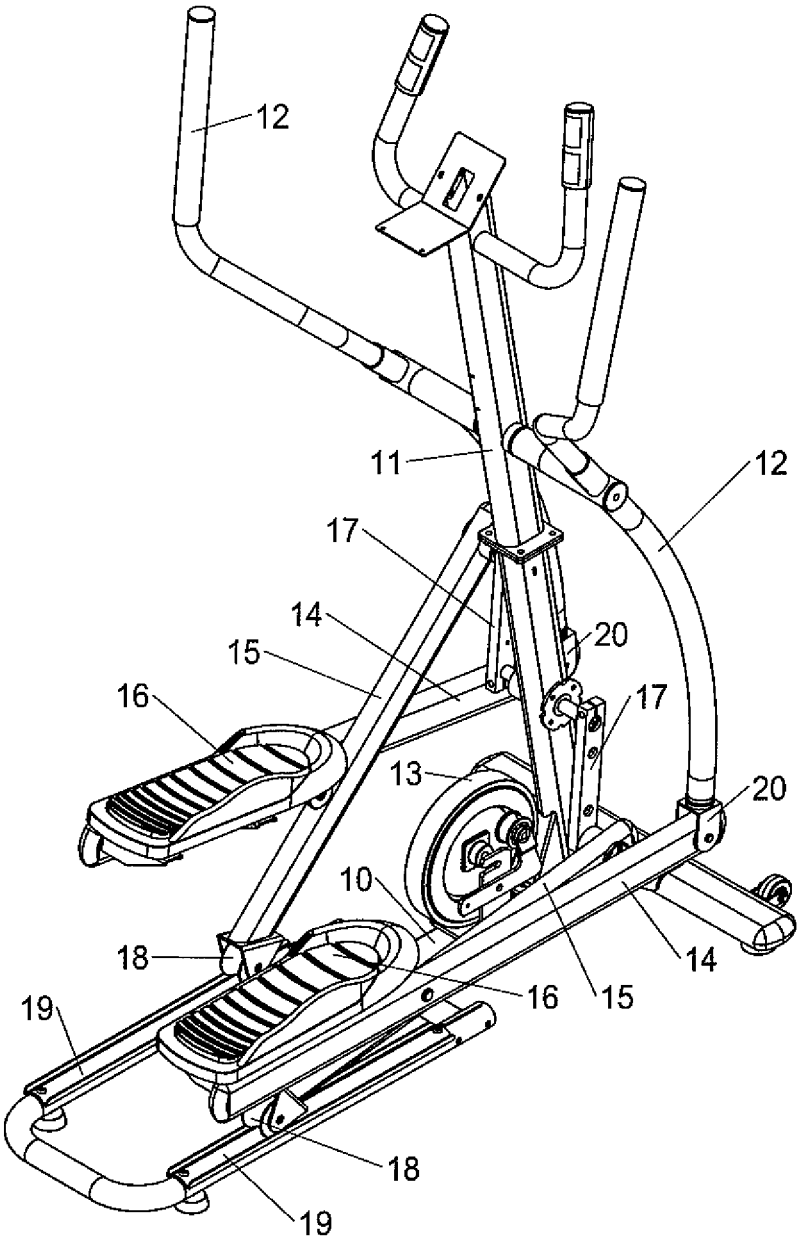
FIG. 3 is a perspective view of an oblong orbital exercising machine in accordance with the preferred embodiment of the present invention.
Figure 4:
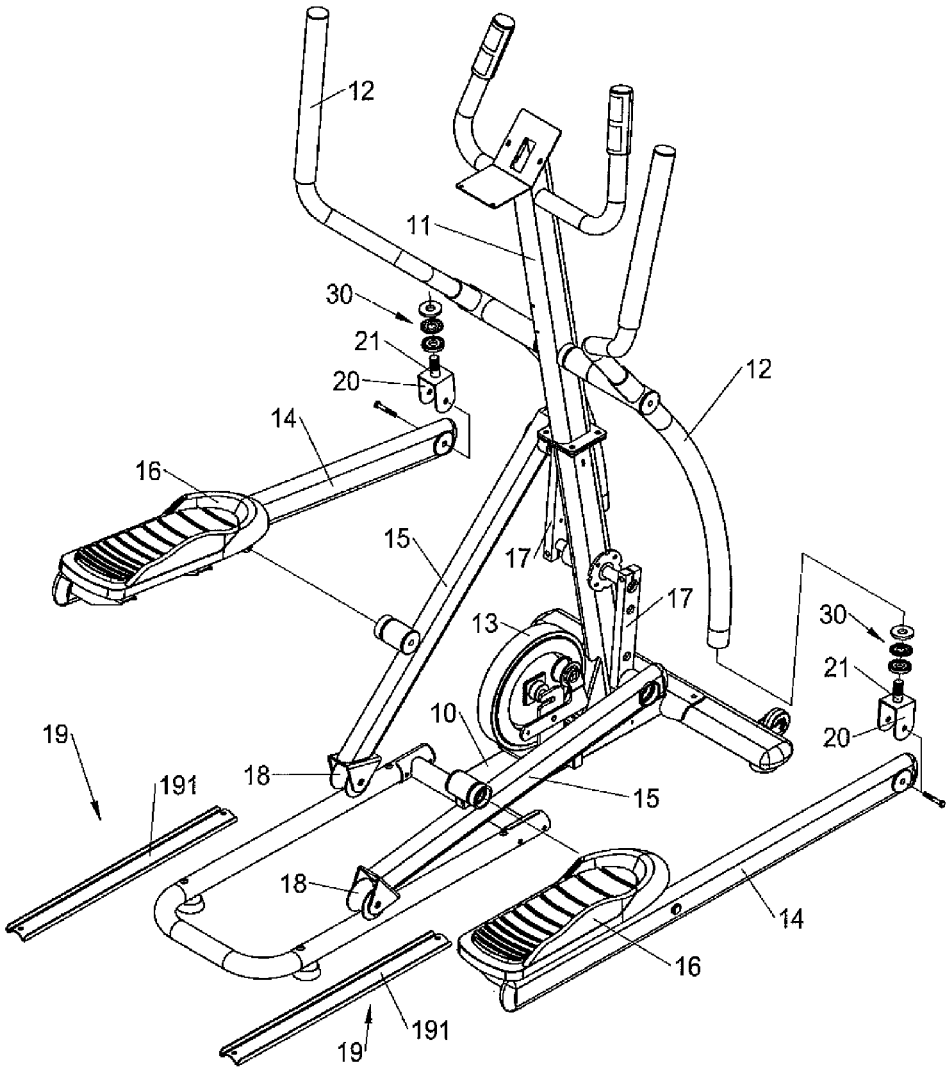
FIG. 4 is a partially exploded perspective view of the oblong orbital exercising machine as shown in FIG. 3.
Figure 5:
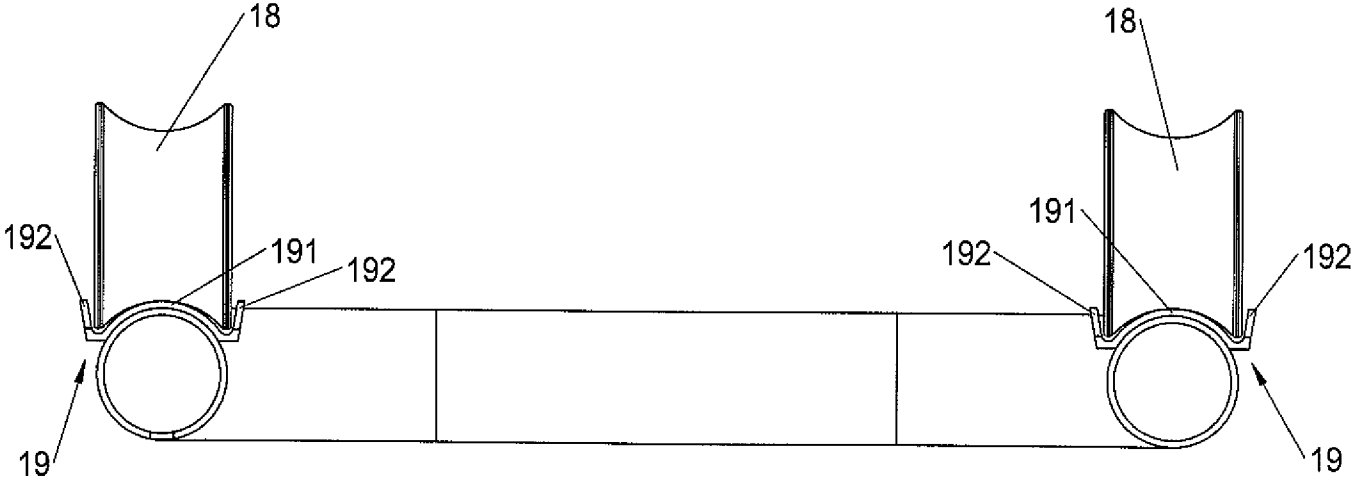
FIG. 5 is a locally enlarged cross-sectional view of the oblong orbital exercising machine as shown in FIG. 3.
Figure 6:
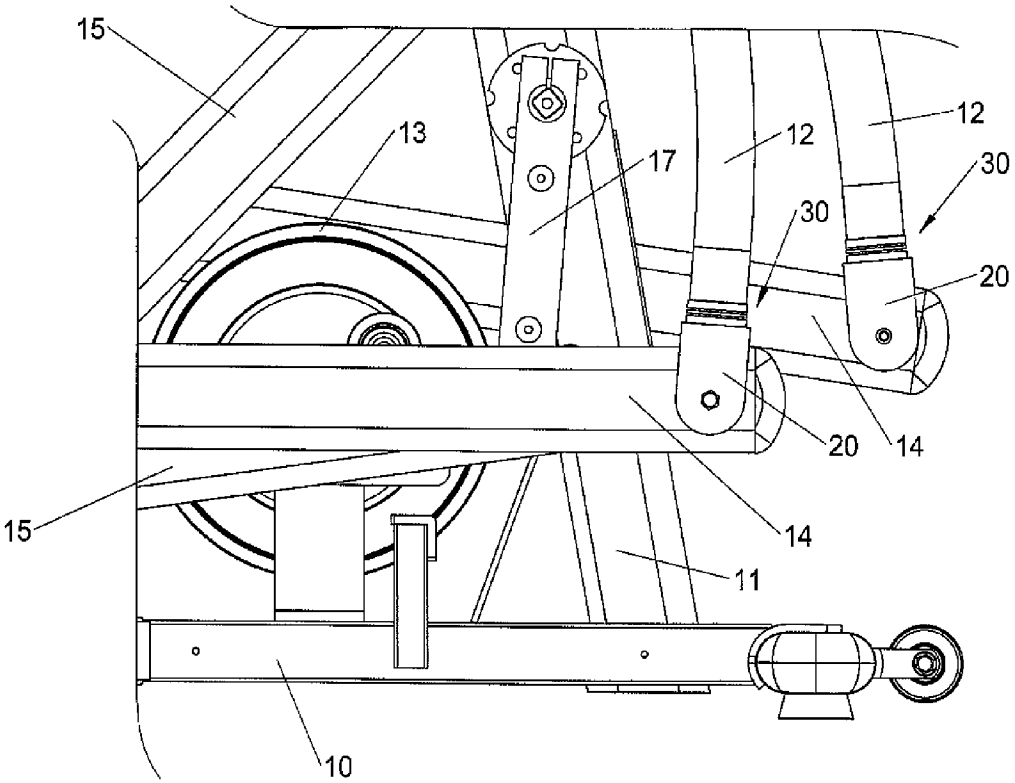
FIG. 6 is a partially front view of the oblong orbital exercising machine as shown in FIG. 3.
Figure 7:
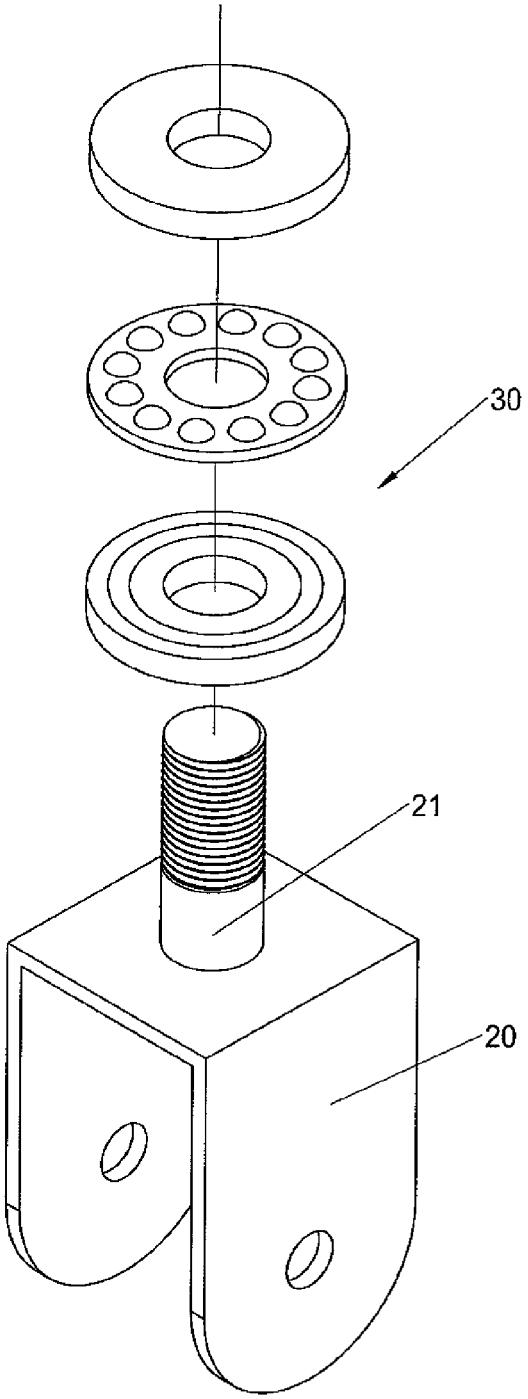
FIG. 7 is a locally enlarged exploded perspective view of the oblong orbital exercising machine as shown in FIG. 4.

Referring to FIGS. 3-7, an oblong orbital exercising machine in accordance with the preferred embodiment of the present invention comprises a main frame 10, an upright 11, two swinging handles 12, a cycle movement mechanism 13, two tread bars 14, two sliding bars 15, two pedals 16, two cranks 17, two rollers 18, two guiding tracks 19, two pivot members 20, and two ball bearings 30.

The cycle movement mechanism 13 is mounted on the main frame 10. The upright 11 is mounted on a front portion of the main frame 10. Each of the cranks 17 has a first end pivotally connected with the upright 11. The cranks 17 have different angles. Each of the sliding bars 15 has a first end pivotally connected with a second end of a respective one of the cranks 17. Each of the guiding tracks 19 is mounted on a rear portion of the main frame 10. Each of the guiding tracks 19 has top face 191. Each of the rollers 18 is mounted on a second end of a respective one of the sliding bars 15 and is slidable forward and backward on the top face 191 of a respective one of the guiding tracks 19. The top face 191 of each of the guiding tracks 19 has an arcuate convex shape to correspond to the respective roller 18. Each of the guiding tracks 19 has two upward extending side wings 192 formed on two opposite sides thereof. Preferably, each of the side wings 192 of each of the guiding tracks 19 is extended upward in an oblique manner from each of the two opposite sides of each of the guiding tracks 19. Each of the swinging handles 12 is pivotally connected with the upright 11. Preferably, the swinging handles 12 are mounted on two opposite sides of the upright 11. Each of the pivot members 20 is pivotally connected with a front end of a respective one of the tread bars 14 and has a top portion provided with a threaded rod 21 threadedly connected with a lower end of a respective one of the swinging handles 12. Each of the pedals 16 is secured on a respective one of the tread bars 14. Each of the ball bearings 30 is located between a respective one of the pivot members 20 and the lower end of a respective one of the swinging handles 12. Each of the ball bearings 30 is mounted on the threaded rod 21 of the respective pivot member 20.

In practice, when each of the rollers 18 is slidable forward and backward on the top face 191 of the respective guiding track 19, each of the rollers 18 is guided by the arcuate convex shape of the top face 191 of the respective guiding track 19, and is limited by the side wings 192 of the respective guiding track 19, so that each of the rollers 18 will not be deflected rightward or leftward during movement, and will not be easily detached from the respective guiding track 19.

In assembly, after other parts of the exercising machine are assembled, the threaded rod 21 of each of the pivot members 20 is pivotally connected with the lower end of the respective swinging handle 12. In such a manner, it usually happens that the threaded rod 21 of each of the pivot members 20 cannot be precisely aligned with the lower end of the respective swinging handle 12 due to an angular deflection. At this time, each of the ball bearings 30 is mounted on the threaded rod 21 of the respective pivot member 20 and is located between the respective pivot member 20 and the lower end of the respective swinging handle 12 to compensate the angular deflection between the threaded rod 21 of the respective pivot member 20 and the lower end of the respective swinging handle 12 so that the threaded rod 21 of the respective pivot member 20 and the lower end of the respective swinging handle 12 are screwed and connected exactly and efficiently.

Accordingly, when each of the rollers 18 is moved on the respective guiding track 19, each of the rollers 18 is guided by the top face 191 of the respective guiding track 19, and is limited by the side wings 192 of the respective guiding track 19, so that each of the rollers 18 will not be deflected rightward or leftward during movement, and will not be easily detached from the respective guiding track 19 to facilitate movement of the rollers 18. In addition, when the threaded rod 21 of each of the pivot members 20 cannot be precisely aligned with the lower end of the respective swinging handle 12 due to an angular deflection, each of the ball bearings 30 on the threaded rod 21 of the respective pivot member 20 is located between the respective pivot member 20 and the lower end of the respective swinging handle 12, so that the threaded rod 21 of the respective pivot member 20 and the lower end of the respective swinging handle 12 are connected exactly and efficiently without incurring detachment.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An oblong orbital exercising machine, comprising:

a main frame, an upright, two swinging handles, a cycle movement mechanism, two tread bars, two sliding bars, two pedals, two cranks, two rollers, two guiding tracks, two pivot members, and two ball bearings, wherein:

the cycle movement mechanism is mounted on the main frame;

the upright is mounted on a front portion of the main frame;

each of the cranks has a first end pivotally connected with the upright;

each of the sliding bars has a first end pivotally connected with a second end of a respective one of the cranks;

each of the guiding tracks is mounted on a rear portion of the main frame;

each of the guiding tracks has top face;

each of the rollers is mounted on a second end of a respective one of the sliding bars and is slidable forward and backward on the top face of a respective one of the guiding tracks;

the top face of each of the guiding tracks has an arcuate convex shape to correspond to the respective roller;

each of the guiding tracks has two upward extending side wings formed on two opposite sides thereof;

each of the swinging handles is pivotally connected with the upright;

each of the pivot members is pivotally connected with a front end of a respective one of the tread bars and has a top portion provided with a threaded rod threadedly connected with a lower end of a respective one of the swinging handles;

each of the pedals is secured on a respective one of the tread bars;

each of the ball bearings is located between a respective one of the pivot members and the lower end of a respective one of the swinging handles; and each of the ball bearings is mounted on the threaded rod of the respective pivot member.

2. The oblong orbital exercising machine of claim 1, wherein each of the side wings of each of the guiding tracks is extended upward in an oblique manner from each of the two opposite sides of each of the guiding tracks.

* * * * *